United States Patent [19]

Rossi

[11] 3,933,264

[45] Jan. 20, 1976

[54] CONTAINER AND CAP WITH TEAR STRIP

[75] Inventor: Anthony T. Rossi, Bradenton, Fla.

[73] Assignee: Tropicana Products, Inc., Bradenton, Fla.

[22] Filed: Sept. 20, 1974

[21] Appl. No.: 507,973

[52] U.S. Cl. ..... 215/254; 220/270; 229/7 R

[51] Int. Cl.[2] ..... B65D 41/32

[58] Field of Search ..... 220/265, 266, 270; 215/254, 256; 229/7 R

[56] References Cited

UNITED STATES PATENTS

| | | | |
|---|---|---|---|
| 1,026,282 | 5/1912 | Schmitt | 215/254 |
| 1,052,382 | 2/1913 | Schmitt | 215/254 |
| 2,967,000 | 1/1961 | Burns | 220/270 |
| 3,314,565 | 4/1967 | Wheaton | 215/254 |
| 3,338,445 | 8/1967 | Lange | 215/254 |
| 3,355,060 | 11/1967 | Reynolds | 220/270 |
| 3,380,609 | 4/1968 | Potts | 215/254 |
| 3,701,454 | 10/1972 | Thorp | 220/270 |
| 3,777,968 | 12/1973 | Law | 229/7 R |
| 3,800,999 | 4/1974 | Serritella | 220/266 |
| 3,856,171 | 12/1974 | Rossi | 215/256 |

*Primary Examiner*—William Price
*Assistant Examiner*—R. E. Hart
*Attorney, Agent, or Firm*—Burns, Doane, Swecker & Mathis

[57] ABSTRACT

A cap for a molded plastic container has a cover section and a seating section which are provided with a tear strip for obtaining drinking or pouring access to the contents of the container without removal of the cap. The cover section has a centrally raised portion and a portion which slopes downwardly and radially outward from the centrally raised portion and terminates in a circumferentially extending seating portion. The latter includes an outer, downwardly extending skirt which embraces the upper end of the container. Two parallel slots extend part way up from the edge of the skirt and terminate in a groove which extends to the edge of the cover section and then follows the surface of the cover section in a generally radial direction to form a tear strip having a continuous, wedge-shaped configuration. The two parallel slots form a tab for grasping the tear strip with the fingers. Because of the shape of the cover section, a twisting motion of the wrist easily tears away the wedge-shaped section along the lines of the groove to provide access to the contents of the container without the need for removing the cap. A fulcrum to enhance tearing action is established by a raised circumferential ridge of the cap against which the container is seated and another fulcrum is established at the juncture of a wall portion of the cap seating section with the sloping portion of the cover section.

5 Claims, 6 Drawing Figures

FIG. 1
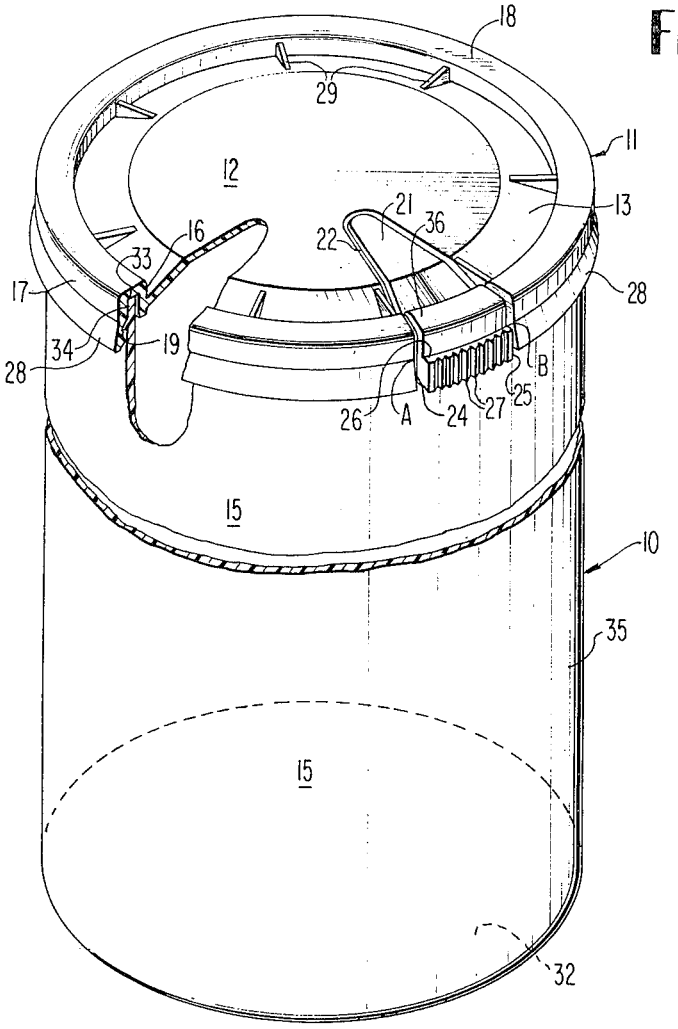
FIG. 3
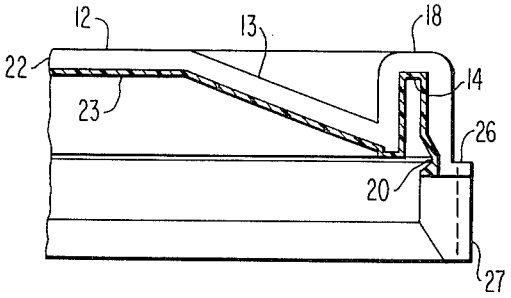
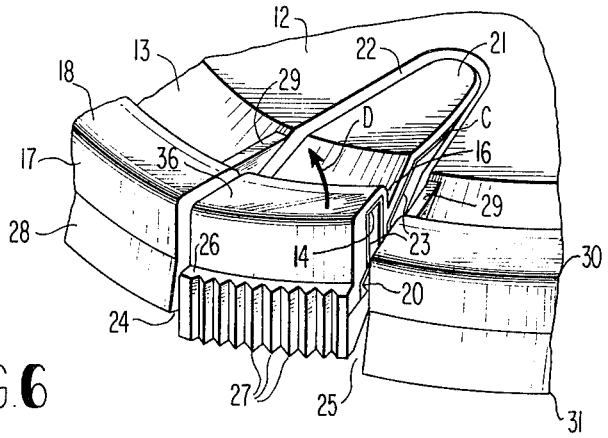
FIG. 6

CONTAINER AND CAP WITH TEAR STRIP

BACKGROUND OF THE INVENTION

This invention relates to caps for containers. More particularly, this invention relates to a cap for a container wherein drinking access to the container is provided by a removable tear strip section of the cap while the cap remains in place.

In the past, a variety of container tops have been provided with pull tabs connected to rings or the like to permit access to the container for drinking or pouring. While such arrangements may be acceptable in certain circumstances, such as in the case of metal container with metal tops, they may not be entirely acceptable in other instances.

For example, molded plastic tops are not particularly amenable to the provision of pull tabs connected to rings or the like.

Acceptable plastic container tops having tear-off pull tabs have been provided in the past. However, these are ordinarily intended for complete removal of the cap. See, for example, my copending application Ser. No. 361,632 filed May 18, 1973, for "Cap Design with Permanently Attached Tear Strip."

Although such caps are particularly desirable in conjunction with container in which frozen orange juice concentrate is maintained, when used with containers in which liquid is maintained, the possibility of spilling or splashing during cap removal exists. The present invention provides a cap wherein drinking or pouring access is established by a tear strip section, while minimizing the likelihood of spilling or splashing. In this connection, a tear strip extending up the side and in part across the top of the cap is employed.

Prior proposals, such as those illustrated in Lange U.S. Pat. No. 3,338,445, issued Aug. 29, 1967, and Schmitt U.S. Pat. No. 1,026,282, issued May 14, 1912, involve caps with tear strips that extend up the side and across a portion of the top of a cap. Among other differences between the present invention and those proposals, the present invention provides a cap construction wherein a novel force interaction between the cap and the container facilitates a relatively smooth tab removal while maintaining the cap in position on the container.

OBJECTS AND SUMMARY OF PREFERRED FORM OF THE INVENTION

It is a general object of the present invention to provide a novel cap for a container, with drinking access to the container being provided by a removable tear strip section while the cap remains in place.

It is a particular object of the present invention to provide such a novel cap with which the possibility of spilling or splashing during the provision of such access is minimized.

It is a further object of the present invention to provide such a novel cap that provides for a novel force interaction between the cap and the container so as to facilitate relatively smooth tearing of a tear section.

A preferred form of the invention intended to accomplish at least some of the foregoing objects includes a cap which has a cover section and a generally inverted U-shaped seating section for receiving the upper side wall portion of a container. A generally wedge-shaped portion, defined by a circumscribing groove of diminished cross section, commencing at the edge of the seating section and converging in a generally radial direction, forms an easily removed tear strip for gaining access to the contents of the container without the necessity for removing the entire cap.

More particularly, in a preferred form, the cap includes a cover section which has a generally central raised portion and a sloping edge portion which slopes downwardly and radially outwardly from the central raised portion toward the periphery of the cap. The cap further includes an inverted, generally U-shaped seating section for receiving the upper side wall portion of the container, which seating section comprises a wall portion, integral with an extending upwardly from the sloping edge portion of the cover section. The seating section further comprises an outer, circumferentially extending, depending skirt portion which embraces the outer side of the container side wall and which extends upwards to a height sufficient to establish a raised circumferential ridge above the sloping edge portion of the cover section.

To gain drinking or pouring access to the contents of the capped container, a tear strip is provided in the cap. This tear strip is bounded, first, by slots which extend upwardly from the bottom edge of the skirt portion toward, but short of, the top of the previously mentioned circumferential ridge. Grooves, commencing with the termination of the slots, then extend upwardly along the skirt portion, across the circumferential ridge, downwardly along the wall portion, and across both the sloping edge portion and at least a part of the central portion of the cap, in generally converging directions. The portion of the skirt which includes the slots serves as a tab to be grasped by the fingers, while the portion of the ridge between the grooves operates to establish a fulcrum about which the portion of the skirt, bounded by the grooves, is pivotable in response to lifting of the just mentioned tab. Furthermore, the portion of the juncture of the wall portion and the downwardly sloping edge portion bounded by the grooves operates to establish a fulcrum in the form of a rigidified zone about which the portion of the wall, bounded by the grooves, is pivotable to initiate removal of that portion of the tear strip which extends along the cover section. To pour or drink the contents of a container covered with a cap in accordance with the present invention, it is merely necessary to grasp the short tab at the edge of the skirt section of the cap and apply a twisting motion through the wrist. The slots flow smoothly into the tear grooves. As the tab is rolled radially outward and upward, the grooves tear positively and smoothly through a "crowbar section." The twisting action on the tab causes one groove to begin to tear ahead of the other, resulting in an extremely smooth tearing action. When the grooves are arranged to come together at a point, the wedge-shaped segment entirely separates from the cap with a minimum of jiggle, thus substantially eliminating the danger of spilling a portion of the contents of the container.

Because the tear strip is so easily dislodged to provide access, it is not necessary for the cap itself to be removable. Accordingly, the cap according to the present invention can be sealed to the container which it covers. This can be accomplished in a number of ways, such as by cementing the cap along the skirt portion. If desired, however, a "snap-on" action similar to that disclosed in the above-mentioned copending application, hereby incorporated by reference, may be employed.

Other objects and advantages of the present invention will become apparent with reference to the following detailed description in conjunction with the accompanying drawings, in which like reference characters refer to like elements and in which:

BRIEF DESCRIPTION OF THE DRAWINGS

FIG. 1 is a perspective view of a cap and container in accordance with the present invention, with a portion cut away to show the interlocking structure of the cap and container;

FIG. 3 is a partial cross section of the cap taken on line 3—3 of FIG. 2, showing an elevational view of a portion of the groove which defines the tear strip;

FIG. 6 is an enlarged, partial perspective view of the cap showing the tear strip partially torn loose from the body of the cap.

DETAILED DESCRIPTION

Referring to FIG. 1, there will be seen a container 10, covered by a one-piece, molded plastic cap indicated generally as 11. The illustrated cap 11 comprises a generally central raised portion 12 and an edge portion 13 which slopes radially downwardly and outwardly from the central raised portion.

Figure 5:
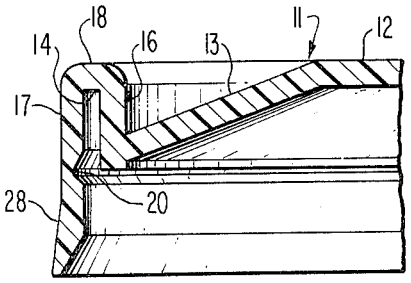
FIG. 5 is a partial cross section taken on line 5—5 of FIG. 2, showing an elevational view of the major portion of the skirt and periphery of the cap.
Figure 4:
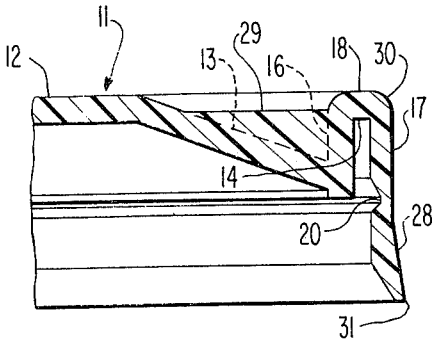
FIG. 4 is a partial cross section of the cap taken on line 4—4 of FIG. 2.

Referring to FIGS. 4 and 5, the cap 11 will be seen to have an inverted, generally U-shaped seating section 14 for receiving the upper side wall portion 15 of container 10. The inverted U-shaped seating section 14 comprises an upstanding wall portion 16, which is integral with and extends upwardly from the sloping edge portion 13, and an outer, circumferentially extending, depending skirt portion 17 for embracing the outer side of the container side wall portion 15. Wall portion 16 and skirt 17 together form a raised circumferential ridge 18 which projects above sloping edge portion 13 of the cover section.

The fulcrum action provided by this ridge 18, discussed more fully below, contributes to the ease of providing drinking and pouring access to the container 10.

Extending across the sloping edge portion 13 of the cover section, immediately adjacent the groove 22 at the two locations where it so extends, are triangular-shaped gussets 29 which aid in rigidifying the cap. Six other such gussets 29 are disposed in uniformly circumferentially spaced locations.

If desired, the container may be provided near its upper edge with a circumferentially extending interlocking projection 19 (FIG. 1), and the inner surface of skirt 17 may be provided with a mating, circumferentially extending seating recess 20 (FIGS. 4 and 5) for interlocking with projection 19 on the container. Alternatively or additionally, the cap 11 may be cemented to the container 10.

In order that drinking or pouring access may be gained to the contents of the container without removing the cap, cap 11 is provided with a removable, wedge-shaped tear strip 21. This tear strip is formed by molding a groove 22 of thinner cross section than the surrounding area of the cap, whereby a zone easier to tear is provided by a line of reduced strength established along the groove. The thinner cross section is designated as 23; being visible in section in FIG. 3 and partially torn in FIG. 6.

The tear strip is bounded by a pair of slots 24 and 25 which extend upwardly from the bottom of skirt portion to points A–B (FIG. 1), adjacent the seating recess 20, and considerably short of the top of the circumferential ridge 18. Commencing with points A–B, grooves 22 extend upwardly along the skirt portion, across ridge 18, downwardly along wall portion 16 of the seating section, across both the sloping edge portion 13, and at least part of central portion 12 in generally converging directions which can be radial. If complete severability of the tear strip 21 is desired, the groove 22 is continuous between points A–B as illustrated. In any event, the groove is arranged to form a tear strip 21 of generally wedge-shaped configuration. Slots 24 and 25 are cuts extending through the entire thickness of skirt 17 and upward as far as points A–B which fall entirely below seating recess 20.

Figure 2:
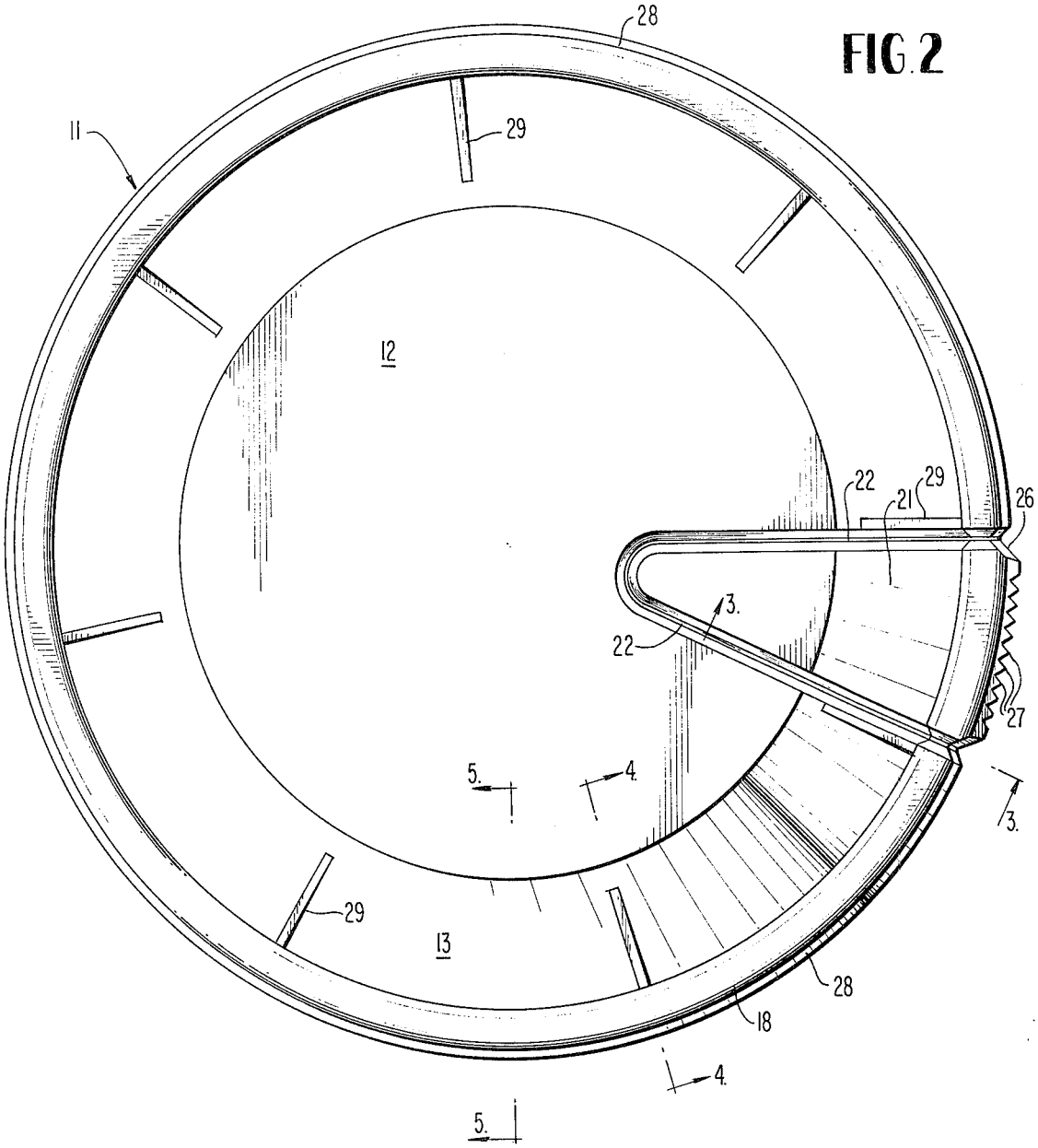
FIG. 2 is a plan view of the cap of FIG. 1 in accordance with the present invention, showing the cover portion.

The portion of skirt 17 between slots 24 and 25 is thickened in an outward direction to form a tab 26 and is provided with a ridged surface 27 to facilitate grasping with the fingers. The lower perimeter of skirt 17 has an outwardly flaring portion 28 as seen, for example, in FIGS. 1 and 2.

Referring once more to FIG. 1, the above-described cap 11 will be seen in place on container 10. Container 10 comprises a bottom wall portion 32 and circumferentially extending side wall portion 15 which terminates at an open upper end which defines an upper container edge 33. As already described, a circumferentially extending interlock projection 19 faces outwardly from side wall 15 and divides the latter into an upper lip section 34 which terminates in upper container edge 33, received by cap seating section 14, and a lower section 35 which extends to the bottom wall section 32 of the container.

In use drinking or pouring access to the contents of the container can be established by tearing away the wedge-shaped tear strip 21. This can readily be accomplished, while minimizing the danger of jiggling and spillage by following the procedure illustrated in FIG. 6. Tearing is initiated by grasping the thickened portion forming the tab 26 between the fingers and lifting the tab end while applying a rotary or twisting motion with the wrist in the direction shown by the curved arrow D in FIG. 6. Because of the presence of slots 24 and 25, sufficient leverage can be applied in connection with the tab 26 to easily rupture the thin, weaker section 23 at point B and to progressively tear the weaker section 23 along the contour of groove 22. As will be appreciated, the twisting action can be applied equally effectively in the direction opposite to the arrow D.

As earlier noted, the ease of providing drinking and pouring access to the container is significantly enhanced by the ridge 18 on the cap. In this connection, tearing along the groove 22 may be accomplished with a smooth motion and a minimum of effort, despite initial resistance, because the portion 36 of ridge 18 between the grooves operates to establish a fulcrum about which the portion of the skirt that is bounded by the grooves is pivotable in response to the lifting of portion 26 bounded by slots 24 and 25. The upper container edge 33 seated in the seating section 14 and bearing against the ridge 18 further enhances this fulcrum action. Furthermore, that portion of the juncture of the seating section and cover portion, i.e., the juncture of wall 16 and downwardly sloping edge portion 13, which is bounded by the grooves operates to establish an additional rigidified zone about which the portion of wall 16 bounded by the grooves is rotatable to aid in the subsequent smooth initiation of the progressive rupture of thin wall 23 and eventually removal of the portion of tear strip 21 which extends along the cover section 12. This is seen in FIG. 6 where tearing is illustrated as having progressed to a point C along groove 22.

From the foregoing, it will be apparent that the present invention provides for drinking or pouring access to a container through a plastic container top while minimizing the possibility of spilling and splashing during the provision of such access. The novel force interaction between the cap and container so as to facilitate relatively smooth tearing of a wedge-shaped removable section is of significant importance. Particularly the fulcrum action provided at the raised ridge 18 and that provided at the juncture of the upstanding wall 16 and the sloping edge portion 13 enhances the smooth tearing. In addition, after the tab is severed to provide drinking access, a relatively clean zone for drinking is established by reason of the access opening extending fully to the container.

Although the invention has been described with reference to a preferred embodiment thereof, it will be appreciated by those skilled in the art that additions, modifications, substitutions and deletions may be made without departing from the spirit and scope of the invention as defined in the appended claims.

What is claimed is:

1. A molded plastic container cap for closing a container having a circumferentially extending interlock projection, said cap including:

a cover section comprising:

a generally central raised portion, and a sloping edge portion sloping downwardly and radially outwardly from said central raised portion; and an inverted, generally U-shaped seating section for receiving an upper side wall portion of said container, said seating section comprising:

a wall portion integral with and extending upwardly from said sloping edge portion of said cover section, an outer, circumferentially extending, depending skirt portion for embracing the outer side of said container side wall portion, said skirt portion including a circumferentially extending seating recess, for interlocking with said interlock projection of said container, and said wall portion and said skirt section establishing a raised circumferential ridge projecting above said sloping edge portion of said cover section;

said cover section and said seating section including a tear strip portion of the cap for establishing a drinking and pouring access opening through said cap, said tear strip portion being bounded by slots extending upwardly from the bottom of said skirt portion toward but short of the top of said circumferential ridge, and grooves commencing with the termination of said slots and extending upwardly along said skirt portion, across said ridge, downwardly along said wall portion of said seating portion, across said sloping edge portion and at least part of said central portion in generally converging directions;

means disposed adjacent the portion of said grooves extending across said sloping edge portion for rigidifying said cap by engaging said sloping edge portion and engaging said wall portion;

the portion of said ridge between said grooves being operable to establish a fulcrum about which the portion of said skirt bounded by said grooves is pivotable in response to lifting of the portion of said skirt bounded by said slots; and, the portion of the juncture of said wall portion and said downwardly sloping edge portion bounded by said grooves being operable to establish a rigidified zone contiguous with the outer periphery of said downward sloping edge portion, about which rigidified zone the portion of said wall bounded by said grooves is rotatable toward said downwardly sloping edge portion to permit removal of said tear strip by movement of a portion of said tear strip bounded by said slots in a smooth, upward and inward, arcuate path.

2. The container cap of claim 1 wherein said rigidifying means comprises a pair of gussets engaging said sloping edge portion and engaging said wall portion for rigidifying said cap.

3. A cap according to claim 2 wherein:

said grooves extend across said sloping edge portion and at least part of said central raised portion in generally converging radial directions.

4. A cap according to claim 3 wherein the skirt portion thereof between said slots is thickened and ridged and is entirely below said seating recess.

5. The cap of claim 2 in combination with, and sealed along said skirt section, to a container including:

a bottom wall portion;

a circumferentially extending side wall portion terminating at an open upper end defining an upper container edge; and a circumferentially extending, interlock projection on said side wall portion adjacent said open upper end of said container and received by said cap seating recess, said interlock projection facing outwardly of said side wall portion and dividing said side wall portion into:

an upper lip section terminating in said upper container edge and received by said cap seating section beneath and in contact with said ridge, and a lower section extending to said bottom wall portion of said container.

* * * * *